US008646661B2

(12) United States Patent
Paine

(10) Patent No.: US 8,646,661 B2
(45) Date of Patent: Feb. 11, 2014

(54) AEROSOL CAN LIQUID DISPENSER

(76) Inventor: Alan Paine, San Dimas, CA (US)

( * ) Notice: Subject to any disclaimer, the term of this patent is extended or adjusted under 35 U.S.C. 154(b) by 36 days.

(21) Appl. No.: 13/422,372

(22) Filed: Mar. 16, 2012

(65) Prior Publication Data

US 2012/0241473 A1 Sep. 27, 2012

Related U.S. Application Data

(60) Provisional application No. 61/466,697, filed on Mar. 23, 2011.

(51) Int. Cl.
*B65D 83/00* (2006.01)

(52) U.S. Cl.
USPC ..... 222/402.13; 222/108; 222/111; 222/635

(58) Field of Classification Search
USPC ..... 222/649, 645, 146.3, 635, 108, 402.13, 222/111, 182, 287; 239/337, 333; 141/3, 20
See application file for complete search history.

(56) References Cited

U.S. PATENT DOCUMENTS

| | | | | |
|---|---|---|---|---|
| 2,968,441 | A | 1/1961 | Holcomb | |
| 3,203,454 | A | 8/1965 | La Micallef | |
| 3,297,209 | A * | 1/1967 | Pungitore | 222/132 |
| 3,370,756 | A * | 2/1968 | McKinnie | 222/146.3 |
| 3,456,851 | A * | 7/1969 | Skora et al. | 222/205 |
| 3,744,678 | A | 7/1973 | Beres et al. | |
| 3,792,802 | A | 2/1974 | Gores | |
| 3,917,127 | A * | 11/1975 | Berenstain | 222/402.13 |
| 3,981,597 | A | 9/1976 | Cohn | |
| 4,350,299 | A | 9/1982 | Stephenson et al. | |
| 4,368,850 | A * | 1/1983 | Szekely | 239/333 |
| 4,420,099 | A | 12/1983 | Pizzurro et al. | |
| 4,603,992 | A | 8/1986 | Kavoussi | |
| 5,423,458 | A | 6/1995 | Tourigny | |
| 6,688,492 | B2 * | 2/2004 | Jaworski et al. | 222/1 |
| 6,837,396 | B2 * | 1/2005 | Jaworski et al. | 222/1 |
| 7,195,139 | B2 * | 3/2007 | Jaworski et al. | 222/645 |
| 7,798,420 | B2 | 9/2010 | Lind et al. | |

* cited by examiner

*Primary Examiner* — Frederick C Nicolas
*Assistant Examiner* — Bob Zadeh
(74) *Attorney, Agent, or Firm* — Kirk A. Buhler; Buhler & Associates

(57) ABSTRACT

Improvements in an aerosol can liquid dispenser to provide a method to dispense a limited amount of fluid from within an aerosol can and to hold the fluid in a reservoir so it can be intermittently used. An operator may only dispense a few drops of liquid and use only a fraction of the dispensed quantity. The collection reservoir is located in a semi protected enclosure to minimize air flow over the fluid thereby reducing evaporation. A secures mechanism allows the dispenser to be quickly and easily mounted and removed from the top of an aerosol can. A removable cap closure to reduce evaporation of any dispensed fluid held in a reservoir. An overflow reservoir collects any excess fluid where it is held in a separate chamber and can be reclaimed.

14 Claims, 4 Drawing Sheets

AEROSOL CAN LIQUID DISPENSER

CROSS REFERENCE TO RELATED APPLICATION

This application claims the benefit of Provisional Application Ser. No. 61/466,697 filed Mar. 23, 2011 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in dispensing liquid from an aerosol can. More particularly, the present dispenser attaches to the top of an aerosol can and converts the pressurized chemicals within the can to a flowable liquid where it can be collects for intermittent use of the collected liquid.

2. Description of Related Art Including Information Disclosed Under 37 CFR 1.97 and 1.98

When working with metals, mechanical parts, electronics and cosmetic they often require cleaning with solvents. Because these solvents are often very volatile they are often provided in an aerosol can. These solvents are often expensive and spraying large quantities of these solvents can be wasteful. Cleaning often requires some level of scrubbing to aggressively clean in and around areas. The scrubbing is usually performed by collecting the solvent onto a swab or brush and then using the swab or brush to clean the area. The solvent can quickly evaporate from the swab or bush and a user must often collect more solvent to clean the area. Several products and patents have been issued on dispensers that are used with aerosol cans. Exemplary examples of patents covering these products are disclosed herein.

U.S. Pat. No. 2,968,441 issued Jan. 17, 1961 to D. D. Holcomb, U.S. Pat. No. 4,350,299 issued Sep. 21, 1982 to George M. Stephenson et al and U.S. Pat. No. 5,423,458 issued Jun. 13, 1995 to Jay S. Tourigny each disclose a dispensing mechanism for an aerosol can. The dispensing mechanism is essentially an elongated hose that attaches to the aerosol can to dispense the fluid within the can at a location that is distal from the aerosol can.

U.S. Pat. No. 7,195,139 issued Mar. 27, 2007 to Thomas Jaworski et al and U.S. Pat. No. 7,798,420 issued Sep. 21, 2010 to James J. Lind et al both disclose an aerosol dispensing device for delivering an aromatic aerosol. The liquid is dispensed onto a wick where the aroma of the liquid is diffused. These patents do not disclose collecting the liquid where it can be swabbed. These patents further do not provide for a closure to prevent evaporation of the liquid.

U.S. Pat. No. 3,792,802 issued Feb. 19, 1974 to Kenneth W. Gores and U.S. Pat. No. 3,917,127 issued Nov. 4, 1975 to Arthur Z. Berenstain both disclose an aerosol dispensing cap. The cap fits over the top of an aerosol can and a pad or whip is pressed onto the cap to dispense some of the fluid within the aerosol can onto the pad or whip. Any dispensed fluid is collected onto the wipe or pad where it can be used. Neither of these two patents provide for collection of the dispensed fluid or a protective covering to reduce evaporation.

What is needed is needed is a dispenser for an aerosol can where the fluid from within the dispenser can be collected or held for intermittent use. The dispenser should also include a protective covering to reduce evaporation of the dispensed fluid.

BRIEF SUMMARY OF THE INVENTION

It is an object of the aerosol can liquid dispenser to provide a method to dispense a limited amount of fluid from within an aerosol can and to hold the fluid in a reservoir so it can be intermittently used. An operator may only dispense a few drops of liquid and use only a fraction of the dispensed quantity. The collection reservoir is located in a semi protected enclosure to minimize air flow over the fluid thereby reducing evaporation.

It is an object of the aerosol can liquid dispenser to have an adjustment mechanism that allows an operator to set the amount of force, travel or deflection of the reservoir to dispense some fluid from the aerosol can.

It is an object of the aerosol can liquid dispenser includes a securing mechanism that allows the dispenser to be quickly and easily mounted and removed from the top of an aerosol can. The dispenser grips the top sealing lip of the dispenser. This location allows the dispenser to sit within the outer diameter of the dispenser whereby not increasing the outside diameter of the dispenser.

It is an object of the aerosol can liquid dispenser to further include and easily removable cap closure to reduce evaporation of any pooled fluid. The removable cap can the tethered to the dispenser to prevent loss of the cap when the dispenser is moved. The tether can also keep the cap closure from falling onto a table or floor where it may come in contact with contaminants.

It is another object of the aerosol can liquid dispenser to include locating springs that maintain the aerosol can in the dispenser the springs remove backlash from the dispensing nozzle thereby requiring limited travel of the head to dispense fluid from within the aerosol can to the holding reservoir.

It is still another object of the aerosol can liquid dispenser to collect any overflow of fluid into the reservoir. Often the fluid from within the aerosol is expensive and wasted fluid is not economical. Any excess fluid from the reservoir flows into the base of the dispenser where it is held in a separate chamber and can be reclaimed.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
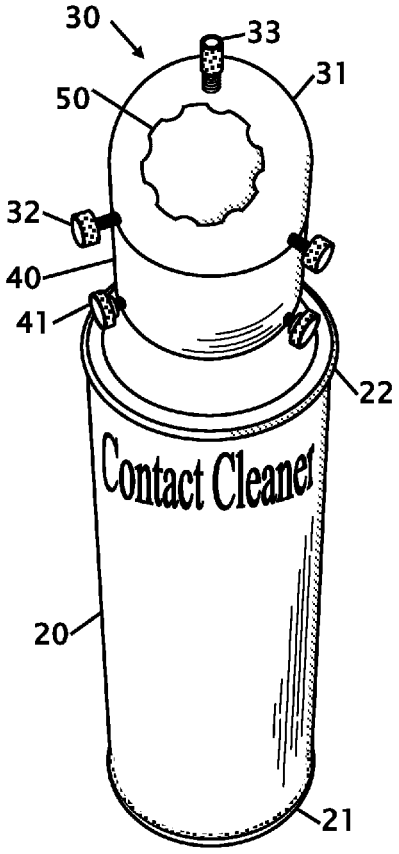
FIG. 1 shows a perspective view of an aerosol can liquid dispenser as a complete assembly in an aerosol can.
Figure 2:
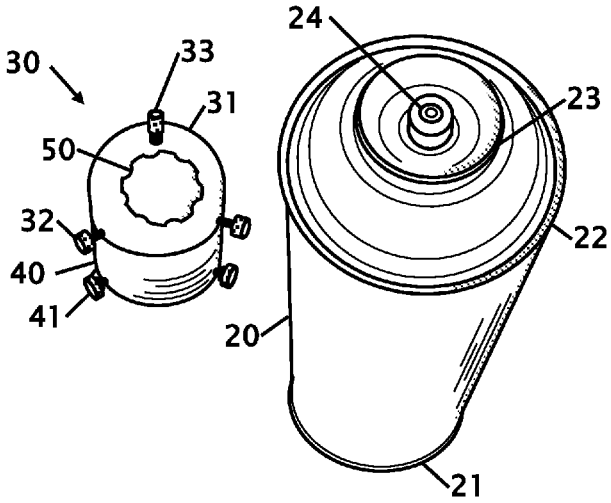
FIG. 2 shows a perspective view of an aerosol can liquid dispenser with the dispenser removed from the aerosol can.

FIG. 1 shows a perspective view of an aerosol can liquid dispenser 30 as a complete assembly in an aerosol can 20 and FIG. 2 shows a perspective view of an aerosol can liquid dispenser 30 with the dispenser 30 removed from the aerosol can 20. The aerosol can 20 has a bottom closure 21 and a top closure 22 that captures a cylindrical sleeve 20 where the material within the can is retained under pressure. An aerosol can 20 can take a number of different sizes and shapes, but in general the circular sealing lip 23 is typically the same size and shape. Within the center of the top of the aerosol can 20 a movable valve 24 is located. Media or liquid from within the can 20 is dispensed from the can 20 out of the movable valve. The internal media or liquid is held under pressure within the aerosol can and when the valve is depressed, rocked or otherwise moved the media or liquid within the aerosol container is expelled out of the valve 24.

The dispenser is configured with an upper housing 31 and a lower housing 40. The lower housing 40 is temporally securable to the circular closure rim 23 of the aerosol can 20 using fastener(s) 41 that grip under the curved sealing neck. The upper housing 31 has a closing mechanism or cap 50 that allows access to a reservoir area within the upper housing 31. When the cap 50 is installed onto the top housing 31 it reduces are movement and therefore reduces evaporation of the media that is dispensed from within the aerosol can 20. The removable cap 50 closure reduces evaporation of dispensed fluid held in the chamber 61 or reservoir (shown and described in figure 6). The upper housing 31 is secured to the lower housing 41 with fasteners 32 that both secure the housings together and allow the two housings to be separated. An adjustment mechanism 33 located at the top of the upper housing allows for preloading of the internal mechanism to minimize operator effort to dispense fluid from within the aerosol can to an internal reservoir or dispensing area. The reservoir or dispensing area is shown and described in more detail in FIGS. 3, 5 and 6.

Figure 3:
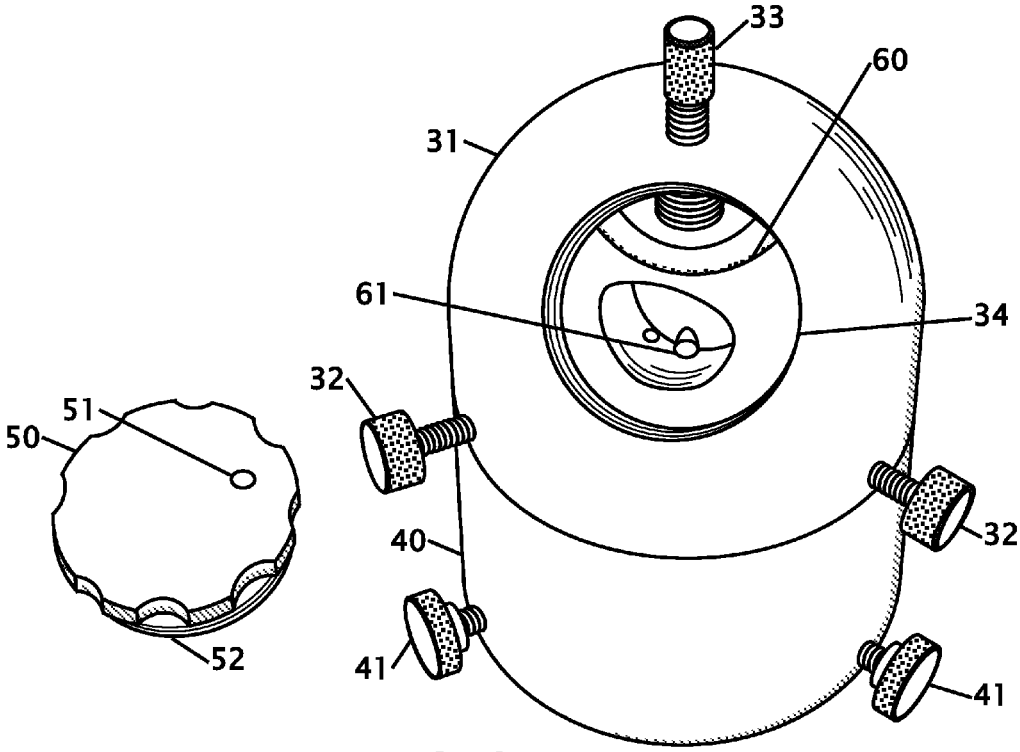
FIG. 3 shows a perspective view of the aerosol can liquid dispenser with the cap removed.
Figure 4:
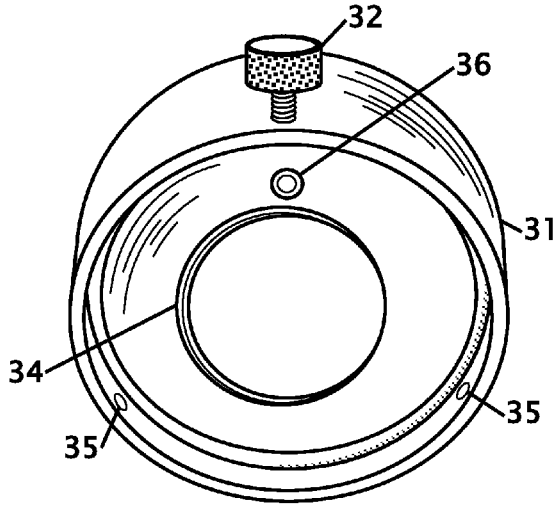
FIG. 4 shows an inside perspective view of the top housing of the aerosol can liquid dispenser.

FIG. 3 shows a perspective view of the aerosol can liquid dispenser with the cap removed and FIG. 4 shows an inside perspective view of the top housing of the aerosol can liquid dispenser. The cap 50 has an outer gripping area that makes the cap easier to grasp, install and remove from the upper housing 31. The cap has a threaded base 52 that threads 34 into the opening if the upper housing 31. Fasteners 41 secure the lower housing onto the aerosol can as previously shown.

A hole 51 is shown in the cap 50 to allow for a tether of wire, chain, cable, string or similar mechanism that prevents the cap from being separated and lost from the upper housing 31. To the right of FIG. 3, the upper housing 31 and the lower housing 40 are shown secured together fasteners 32 that both retain the housings together and prevent rotation of the upper housing 31 on the lower housing 40. In the preferred embodiment the upper housing 31 and the lower housing 40 are made from aluminum, but other materials are contemplated including but not limited to steels, plastics or copper based materials. The right view from FIG. 3 shows the adjustment mechanism 33 passing though the top housing 31 where it is visible as item 36 in FIG. 4. The end 36 of the adjustment mechanism 33 depresses the top of the head 60 as shown in FIG. 3. In FIG. 4, one of the fasteners 32 is shown installed inside of the upper housing and the threaded holes 35 where supplemental fasteners will be threaded are also shown.

Figure 5:
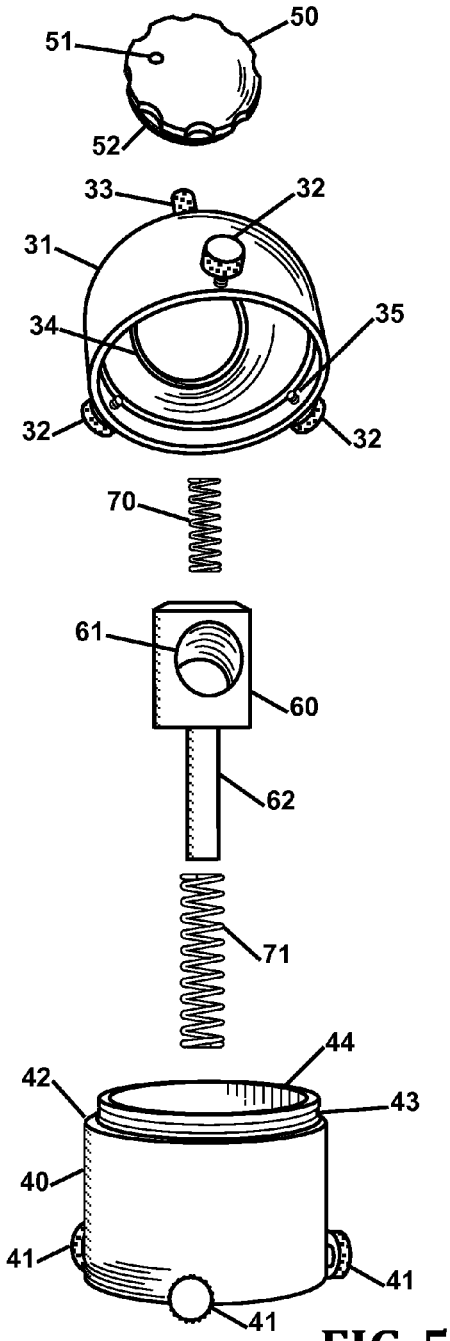
FIG. 5 shows a perspective exploded view of the aerosol can liquid dispenser.
Figure 6:
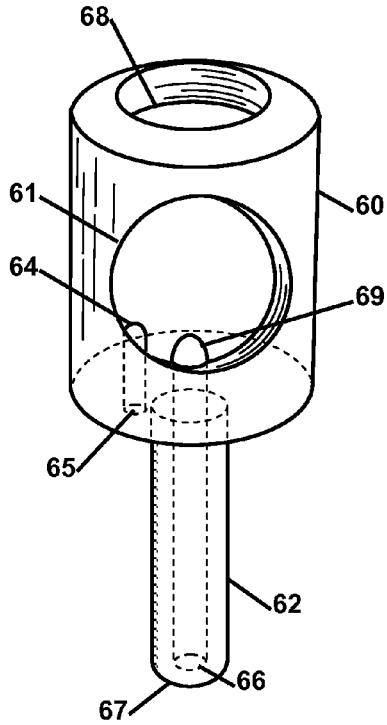
FIG. 6 shows a detailed perspective view of the activation head.

FIG. 5 shows a perspective exploded view of the aerosol can liquid dispenser and FIG. 6 shows a detailed perspective view of the activation head 60. The exploded view 5 gives the best representation of the various components and how they are assembled in the dispenser. Starting with the lower housing 40 the fasteners 41 are shown. The preferred embodiment has three threaded fasteners placed approximately 120 degrees apart, but more or less fasteners are contemplated including and embodiment with only one fasteners and a lip that hooks under the top closure 22 (from FIG. 1). The top of the lower housing 40 has a shoulder 42 where the upper housing 31 rests. A vertical inside wall has a notch or seat 43 where the fasteners 32 of the upper housing engage to grip the lower housing 40. The top 44 of the lower housing 40 also has a seat that nests within the upper housing. A spring 71 nests within the lower housing and fits around the shaft 62 of the dispensing head 60. A detailed drawing of the head dispensing 60 is shown and described in FIG. 6.

From FIG. 6 the dispensing head 60 has an elongated shaft 62 with a hole 66 that passes from the base of the dispensing head into the dispensing or accumulation reservoir 61 through opening 69. The opening 61 of the dispensing or accumulation reservoir 61 is angled to retain any dispensed fluid within the dispensing or accumulation reservoir 61. A separate drain hole from 64 within the dispensing or accumulation reservoir 61 to outside 65 of the dispensing or accumulation reservoir 61 that allows any excess fluid to drain into a collecting pool that will be shown and described in more detail with FIG. 8. The bottom 67 of the dispensing head rests on the movable valve 24 of the aerosol dispenser (from FIG. 2) to allow fluid from the aerosol container to flow through the hole 66 and into the dispensing or accumulation reservoir 61 through opening 69. The top of the dispensing head 60 has a recessed area for locating the top spring 70 shown in FIG. 5.

The spring 70 rests within the recess 68 on the head 60 and further exists around the end 36 of the adjustment mechanism 33. The upper housing 31 is shown with all three fasteners 32 installed. The tip 35 of one the fasteners 32 is shown extending through the wall of the upper housing 31. The tip 35 of the fastener 32 engages into the notch or seat 43 of the lower housing 40. The opening 34 in the upper housing is visible where a user will reach or pass a cleaning tool through to collect fluid from the collection chamber 61 or reservoir. The closure cap 50 is shown with a threaded base 52 that threads 34 into the opening if the upper housing 31. A hole 51 is shown in the cap 50 to allow for a tethering the cap 50 onto the dispenser.

Figure 7:
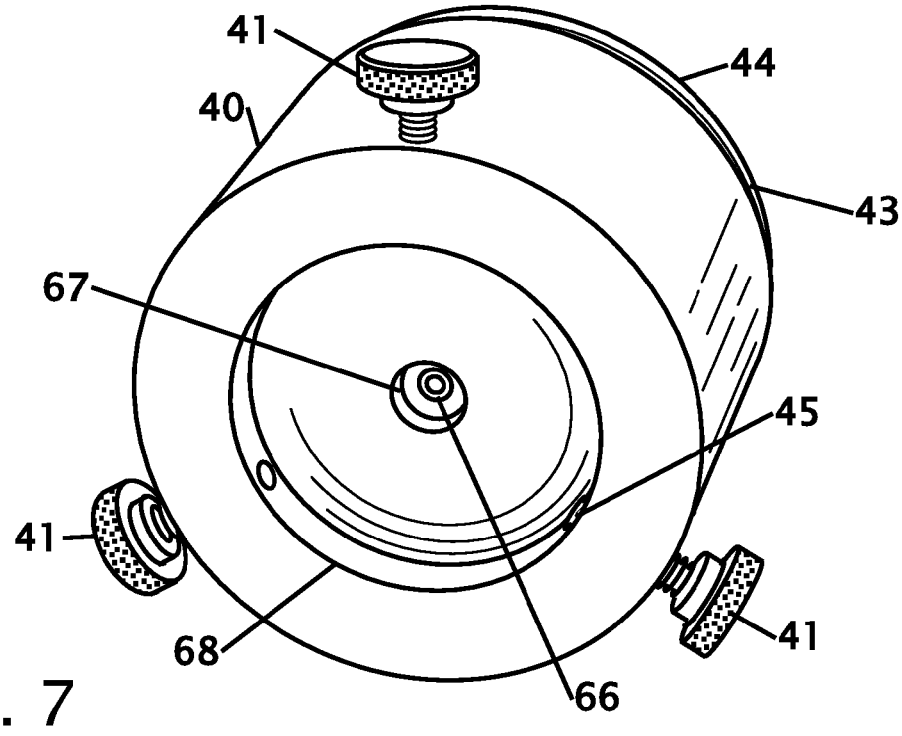
FIG. 7 shows a bottom perspective view of the bottom housing.

FIG. 7 shows a bottom perspective view of the bottom housing FIG. 7 shown just the bottom of the lower housing has a recess 68 where the circular closure rim 23 (from FIG. 2) of the top of the aerosol can 20 is placed and secured with the fasteners 41. The tip of one of the fasteners 45 is shown in FIG. 7. The seating notch 43 and an edge 44 of the top of the lower housing are visible. In the center of the recess 68 the bottom of the head is visible 67 with a hole 66 where fluid from the aerosol container passes through to opening 69 (shown in FIG. 6) for storage and dispensing.

Figure 8:
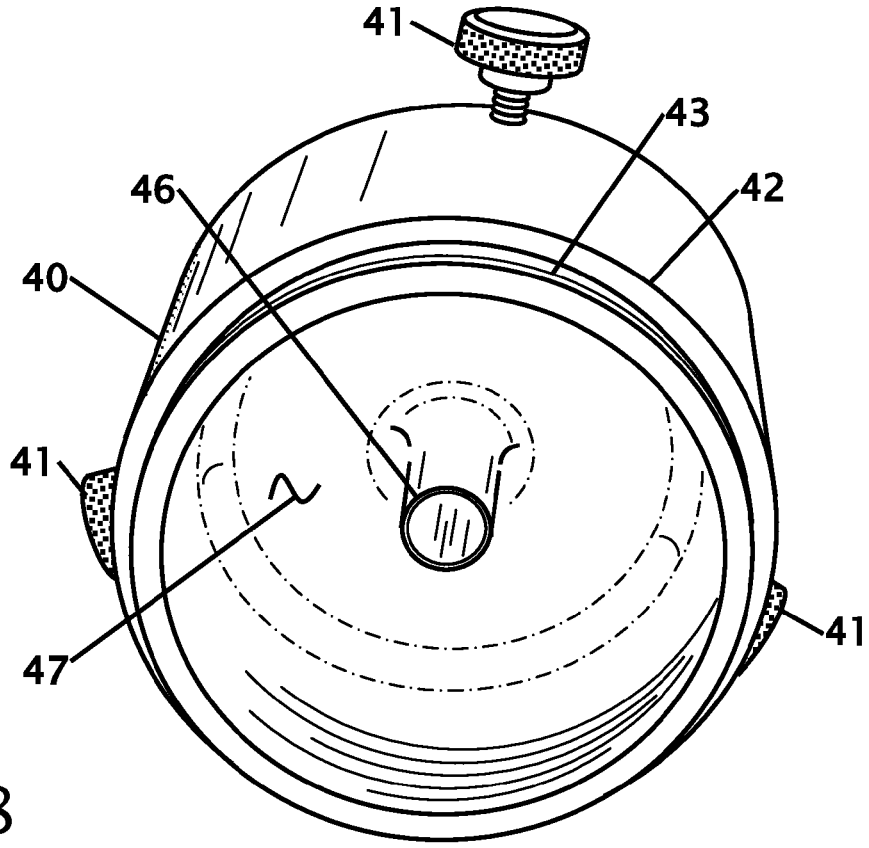
FIG. 8 shows an inside perspective view of the bottom housing.

FIG. 8 shows an inside perspective view of the lower housing 40 with the shoulder 42 and the notch or seat 43 where the tip(s) 35 of fasteners 32 engage. As previously described, the head (shown in FIGS. 5 and 6) has an overflow hole 64, 65. Fluid that overflows will drain down the cylindrical shaft 46 and is collected in the overflow reservoir 47 where it can be reclaimed.

The fasteners 32 and 41 as well as the adjustment mechanism 33 are shown and or described as threaded fasteners or screws, but other devices are contemplated that would provide equivalent or superior performance. Thus, specific embodiments of an aerosol can liquid dispenser have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An aerosol can liquid dispenser comprising:

a bottom housing that is securable onto an aerosol can;

a top housing that is securable to said bottom housing;

an actuation head for dispensing some liquid within said aerosol can;

an angled cavity that creates a collection reservoir to hold some of said dispensed liquid from said aerosol can;

said angled cavity is located within said to and said bottom housing, and said collection reservoir further includes an overflow drain that directs overflow liquid from said collection reservoir into an overflow reservoir.

2. The aerosol can liquid dispenser according to claim 1 wherein said dispensed liquid is paint, solvent, adhesive, cleaning agent or insecticide.

3. The aerosol can liquid dispenser according to claim 1 wherein said actuating head is adjustable.

4. The aerosol can liquid dispenser according to claim 1 wherein said actuating head is spring loaded.

5. The aerosol can liquid dispenser according to claim 1 wherein said actuating head includes a hollow central flow path.

6. The aerosol can liquid dispenser according to claim 1 wherein said bottom housing has at least one securing means to secure said bottom housing onto said aerosol can.

7. The aerosol can liquid dispenser according to claim 1 wherein said top housing has at least one securing means to connect to said bottom housing.

8. The aerosol can liquid dispenser according to claim 1 wherein said top housing and or said bottom housing is made from metal or plastic.

9. The aerosol can liquid dispenser according to claim 1 wherein said top housing and said bottom housing is resists degradation for material dispensed from said aerosol can.

10. The aerosol can liquid dispenser according to claim 1 wherein said actuation head is configured to depress a valve on said aerosol can.

11. The aerosol can liquid dispenser according to claim 1 wherein said actuating head is configured to transfer material from within said aerosol can to said collection reservoir.

12. The aerosol can liquid dispenser according to claim 1 wherein said aerosol can liquid dispenser reduces evaporation of material collected in said collection reservoir.

13. The aerosol can liquid dispenser according to claim 1 that further includes a removable cap.

14. The aerosol can liquid dispenser according to claim 13 wherein said removable cap threads onto said top housing.

* * * * *